US005441228A

United States Patent [19]

Geborek

[11] Patent Number: 5,441,228

[45] Date of Patent: Aug. 15, 1995

[54] DOCUMENT HOLDING AND DISPLAY DEVICE

[76] Inventor: Thomas H. Geborek, 17528 W. Woodland Dr., Grayslake, Ill. 60030

[21] Appl. No.: 202,327

[22] Filed: Feb. 28, 1994

[51] Int. Cl.[6] ..... A47B 23/00

[52] U.S. Cl. ..... 248/441.1; 248/444.1; 248/451

[58] Field of Search ..... 248/441.1, 451, 447, 248/449, 452, 453, 444.1, 450; 40/530, 535, 536; 281/45

[56] References Cited

U.S. PATENT DOCUMENTS

| | | | |
|---|---|---|---|
| 861,722 | 7/1907 | Haas . | |
| 2,194,019 | 8/1938 | Hartsel | 120/28 |
| 3,041,774 | 7/1962 | Walker | 45/64 |
| 3,603,554 | 9/1971 | Dickinson, III | 248/453 |
| 3,848,547 | 11/1974 | Schaefer | 109/49.5 |
| 4,466,638 | 8/1984 | Miskin | 281/33 |
| 4,531,642 | 7/1985 | Racich | 211/42 |
| 4,834,334 | 5/1989 | Robins | 248/441.1 |
| 4,877,213 | 10/1989 | Lambert | 248/451 |
| 4,892,334 | 1/1990 | Sinclair | 281/45 |
| 4,925,143 | 5/1990 | Sandmeyer | 248/441.1 |
| 5,028,075 | 7/1991 | Donnelly | 281/49 |

*Primary Examiner*—Leslie A. Braun
*Assistant Examiner*—Anita M. King
*Attorney, Agent, or Firm*—Jon Carl Gealow; Keck, Mahin & Cate

[57] ABSTRACT

A document holding and displaying apparatus which holds a plurality of documents and displays one of the documents. The apparatus includes a first support member which is generally of the same size of the documents, to which the documents are secured at a first edge by a spring biased clip. A second support member is hinged adjacent a first edge to the first support member adjacent to its first edge. Documents on top of the document to be displayed are folded over a second edge of the second support member which is one half the length of the first support member. The edges of the first and second support members perpendicular to the first edges are provided with inwardly facing channels for retaining the edges of the documents.

15 Claims, 1 Drawing Sheet

FIG. 1
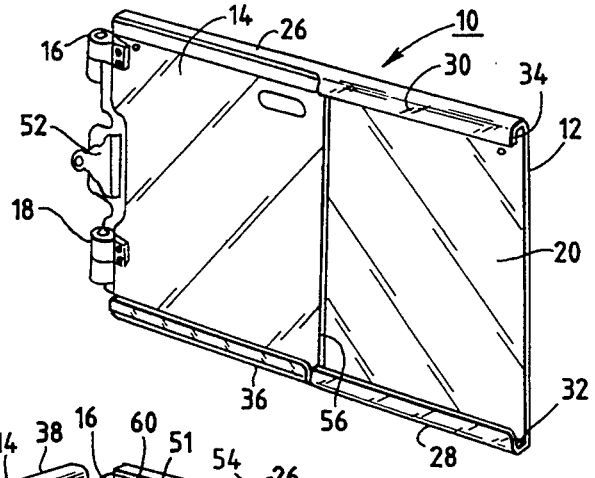
FIG. 4
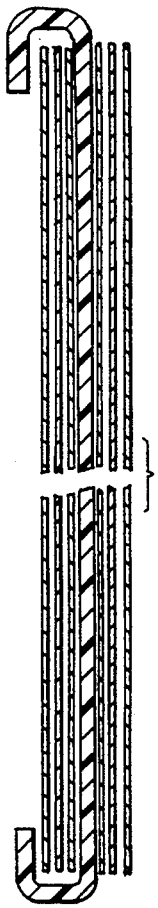
FIG. 2
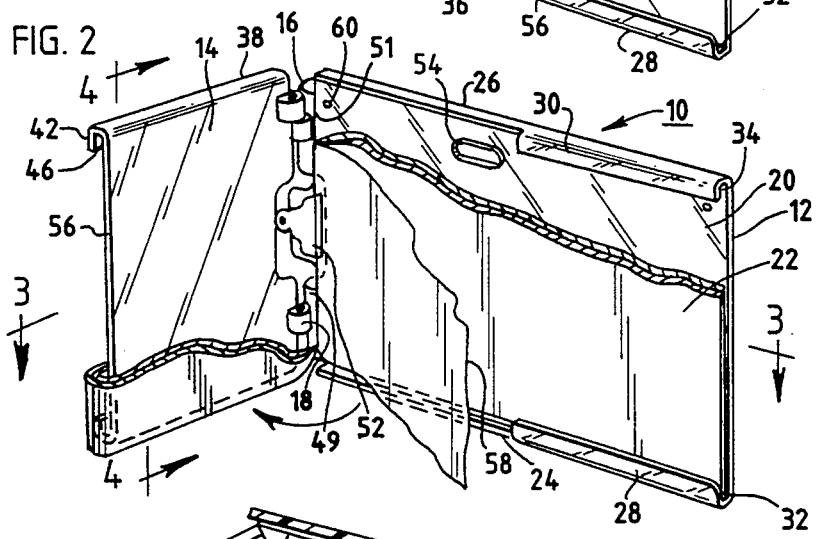
FIG. 3
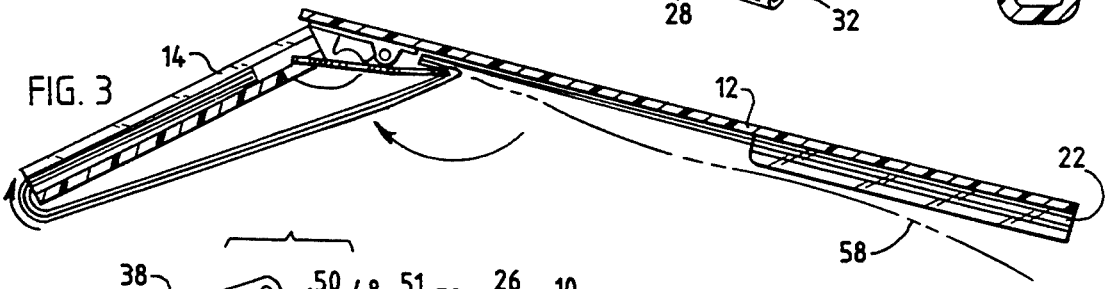
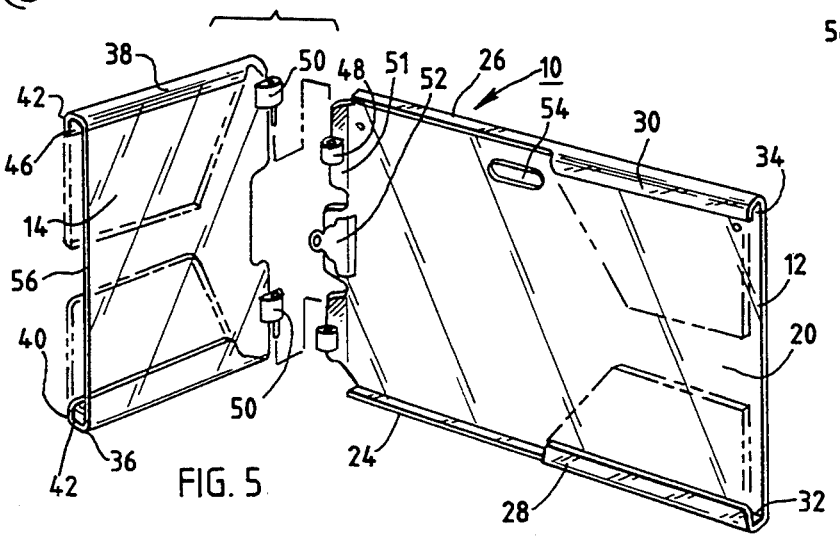
FIG. 5
FIG. 6
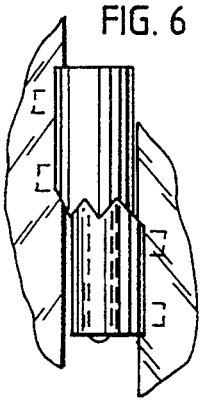

DOCUMENT HOLDING AND DISPLAY DEVICE

BACKGROUND OF THE INVENTION

1. Field of the Invention

This invention relates to a device for holding a plurality of documents and for readily displaying one of the documents. More particularly, if it is desired to display a document located within a stack of documents, the documents on top of the one to be displayed are supported and retained in a position whereby the desired document may be readily viewed.

2. Description of Related Art Including Information Disclosed under 35 C.F.R. 1.97 and 1.98

Particularly when working at a desk or table, there is usually more than ample room available for two stacks of letter size, 8½"×11", or legal size, 8½"×14" documents. That is, pages may be flipped from one pile to another to bring into view the desired document. However, when working with stacks of larger size documents, handling the documents in the same way, i.e., from pile to pile, quickly takes up all of the room on the disk or table, making it difficult to also have available for use other reference and work materials. Building plans, mechanical drawings utilized in the specification of parts, assembly drawings, architectural plans, and electrical and electronic schematics are frequently prepared on larger sized sheets of paper. To some extent the following standard paper sizes have been established for engineering type drawings or prints:

| SIZE | DIMENSION (INCHES) |
|---|---|
| A | 8½ × 11 |
| B | 11 × 17 |
| C | 17 × 22 |
| D | 22 × 34 |
| E | 36 × 44 |

Standard sizes for architectural drawings are somewhat different. For instance, the "D" size is 24"×36".

When viewing documents or prints of the larger sizes, B through E, it is desirable to have a mechanism for holding and displaying them in an upright position with respect to a horizontal work surface, such that the major portion of the work surface will be available for supporting other materials such as reference books. It is further desirable that the sheets in a stack of sheets above the sheet which is to be displayed be supported as well as those sheets below the sheet to be displayed. Such an apparatus in the form of a holder or display device which can be set on top of a desk or hung on a wall in an office is also desirable at a construction site where it might be hung on a wall, or placed on an easel or on another work surface such as the top of a large tool container which are frequently used at construction sites.

The applicant is unaware of such an apparatus or holder existing in the prior art. Devices utilized for holding multiple sheets of paper in the past include easels such as disclosed in U.S. Pat. Nos. 861,722, issued Jul. 30, 1907 and 4,877,213 issued Oct. 31, 1989. Such easels are most typically designed to hold documents in a somewhat vertical position wherein the longer dimension extends in the vertical direction. The documents above the one to be viewed are typically folded over the top of the easel so as to rest behind the easel. Somewhat similar to easels is the copy holder shown in U.S. Pat. No. 2,194,019, issued Mar. 19, 1940. The copy holder is a hinged stand with a spring means for retaining documents on an inclined table 17. The applicant is also aware of U.S. Pat. No. 4,531,642, issued Jul. 30, 1985 which reveals a portable desk having a pair of clips for supporting documents on an inclined surface. The portable desk also includes a bookrest along the lower edge of the inclined surface. Finally, U.S. Pat. No. 4,925,143, issued May 15, 1990 discloses a document holding assembly having two vertical and two inclined support surfaces, all of which are essentially the same size and each of which is provided with a clip means for holding documents on its surface. None of the above-mentioned patents disclose, nor is the applicant aware of an apparatus suitable for retaining a stack of large size documents or prints wherein both sheets above and below a sheet to be displayed are retained, and which may be used on a desk top, hung on a wall, or supported by an easel.

SUMMARY OF THE INVENTION

It is an object of this invention to provide an apparatus or device for holding a plurality of documents or prints, for displaying one of the documents, and for holding and supporting both the documents on top of and the document below the document to be displayed. It is a further object of this invention to provide a device for holding a plurality of documents and for displaying one of the documents which is readily supported on a flat surface, hung on a vertical surface or supported by an easel. It is a further object of this invention to provide a device for holding a plurality of documents, for displaying one of the documents, and which is readily carried by hand with the documents secured thereon.

In accordance with this invention., a device for holding a plurality of documents, and displaying one of the documents, is formed of two support members. A first support member is formed with a generally rectangular flat surface, the dimensions of which are slightly larger than the dimensions of the size document to be supported thereon. In describing a preferred embodiment of this invention, the longer sides will be referred to as the top and bottom and the shorter dimensions as the sides. A second support member is also formed with a generally rectangular flat surface one dimension of which is essentially the same as that of the sides of the first support member and will be referred to as the sides, and the other dimension of which is approximately one half of the length of the top and bottom of the first support member and will be referred to as the top and bottom. Retaining means, such as U-shaped channels, are provided along the top and bottom edges of both the first and second members. Adjacent side edges of the first and second members are hinged to each other. A releasable securing means, such as a spring loaded clamp, for securing the documents to the first support member is located adjacent to the hinged side edge of the first member.

With the first and second support members hinged to each other, and the second support member laying on top of the first support member, the retaining means on both members extend over their upper surfaces. When it is desired to view a document or a print, other than the top print, in a stack of prints retained on the first member, those prints above the print to be viewed are pulled out of the U-shaped channels on the first member. They are then folded around the free side edge of the second member, which is opposite the hinged side edge, and placed in the U-shaped channels on the second member.

In a preferred embodiment, the hinges are provided with detent means, whereby the second member may be held in predetermined positions at various angles to the first member. Thus, when it is desirable to view documents retained on the device at a desk, the first member may be placed in a vertical position directly in front of the user and the second member positioned at an angle of 90° or somewhat greater angle to the first member such that it extends on the left side toward the viewer. Since the two members are at a significant angle with respect to each other, they will stand in a vertical position on a flat horizontal surface without the need for additional support.

A pair of apertures are provided near the upper edge of the first member such that they may engage nails or similar devices projecting from a wall or other vertical surface, so as to hang the device thereon. Further, the device may be supported by an easel if an appropriate retaining means is provided at the top of an easel to prevent the device from tipping forward due to the weight of the second member.

BRIEF DESCRIPTION OF THE DRAWINGS

FIG. 1 a perspective view of the device for holding a plurality of documents and for displaying one of the documents in accordance with this invention, with the hinged members of the device in a first position with respect to each other.

FIG. 2 is a perspective view of the device of this invention with the hinged members at approximately right angles to each other.

FIG. 3 is a view taken along the lines 3—3 in FIG. 2.

FIG. 4 is a cross-section taken along the lines 4—4 in FIG. 2.

FIG. 5 a perspective view showing the hinges on the first and second members disengaged from each other.

FIG. 6 is an enlarged elevation view, partially in sections, showing one of the hinges utilized to secure the first and second members to each other.

DETAILED DESCRIPTION OF THE PREFERRED EMBODIMENT

Referring to FIGS. 1 and 2, a device 10 in accordance with this invention is illustrated. The device includes a first support member 12, and a second support member 14, connected to each other by a pair of hinges 16 and 18. The first support member 12 is formed with a generally rectangular flat surface 20 having height and width dimensions slightly larger than those of the documents or prints 22 to be supported thereon.

In the embodiment of the invention illustrated in the figures of the drawings the support members 12 and 14 are formed of sheets of translucent or clear plastic material. The first support member 12 is formed of a sheet of material the width of which is sufficiently greater than that of the prints 22 such that the top and bottom edges may be bent at right angles to form side members 24 and 26 to confine and protect the top and bottom edges of the prints. On the right half of the first support member 12, the side members 24 and 26 are provided with retaining portions 28 and 30 which are bent at right angles to the side members 24 and 26 to form U-shaped channels 32 and 34 to retain the loose ends of the prints 22.

The second support member 14 is approximately one half as long as the first support member 12. The upper and lower edges of support member 14 are also provided with side members 36 and 38 and retaining portions 40 and 42 at right angles thereto so as to form U-shaped channels 44 and 46.

As illustrated in FIG. 5, each of the hinges 16 and 18 consist of two portions, 48 and 50, one of which, 50, includes a stem and the other of which, 48, includes an aperture for receiving the stem. The abutting surfaces of hinged portions 48 and 50 are provided with saw tooth like surfaces as shown in FIG. 6. By varying the positions in which the saw tooth like surfaces engage each other, the relative angular positions of the first and second support members 12 and 14 with respect to each other may be adjusted.

The portion of the first support member 12 on which the hinge portions 48 are mounted is bent at 49 and 51 at an obtuse angle to the flat surface 20 of the first member. Because of the bends, portions of the fastening means located on the back side of the first support member 12 (not shown) will not engage the surface on which, the first support member is resting. Further, with the particular type of hinges shown in the figures, the angular position of the portion of the first support member 12 on which the hinged portions 48 are mounted permits the members 12 and 14 to close upon each other as shown in FIG. 1.

Referring again to FIG. 1, a plurality of prints 22 are shown to be clipped to the first support member 12 by a spring loaded clip 52 positioned between the hinges 16 and 18 with their top and bottom edges retained in the U-shaped channels 32 and 34. With the second support member 14 rotated to be positioned over and parallel to the first support member 12, as shown in FIG. 1, the device 10 and the prints 22 retained thereon may be readily carried by a user engaging his hand in a hand hole 54 provided in the first support member 12.

Referring to FIGS. 2 and 3, to view a print other than the top one, the prints above the print to be viewed are pulled out of the U-shaped channels 32 and 34 on first support member 12 and folded over outer edge 56 of the second support member 14 and directed into the U-shaped channels 44 and 46 formed on the second support member. As illustrated in FIG. 2, several of the prints are retained by the U-shaped channels 32 and 34 on the first support member 12, while other prints are shown retained by the U-shaped channels 44 and 46 on the second support member 14. Referring to FIG. 4, it will be observed that prints are positioned on each side of the second support member 14, and are retained on the left side by the U-shaped channels 44 and 46 at the bottom and top of member 14. A print 58 is shown to be free from the U-shaped channels on both support members and positioned to be moved in the direction of the arrow A in FIGS. 2 and 3 to be supported by the second support member 14.

The device 10 as shown in FIG. 2 is readily self-supporting in a vertical position on a flat horizontal surface for viewing the top print retained on the first support member 12. The first support member 12 is also provided with apertures 60 and 62 which may be utilized to receive pins or nails extending from a vertical surface, such as a wall in an office or at a construction site, to hang the device 10 in a vertical position, whereby the prints may be retained and the top print on the first support member 12 observed. The device 10 for retaining and displaying prints may also be supported on an easel, with the lower side member 24 of the first support member 12 resting on the shelf of the easel. However, due to the weight of the second support member 14 and of the documents wrapped around it, it is necessary that the top of the first support member 12 be secured to the easel such that the print device 10 does not tip off of the easel.

In an alternate embodiment of the invention it may be desirable to more securely hold the prints on support members 12 and 14. This may be accomplished by extending the retaining portions 28 and 30 on support member 12 and retaining portions 40 and 42 on support member 14 toward each other as shown by the phantom lines in FIG. 5.

While the U-shaped channels 32 and 34 on the first support member 12 and 44 and 46 on the second support member 14 are shown to be formed by bending flat sheets forming those members, they may also be formed as separate channels which are secured to the flat portions of the support members 12 and 14 by rivets, adhesive or other fastening means. While in the preferred embodiment, the support members 12 and 14 are formed from transparent plastic sheets, it may be desirable, particularly when the device is intended for use on construction sites, to form the support members of a metal such as aluminum or magnesium, which are desirable because of their lighter weight.

While a particular type of spring loaded clip 52 and a particular type of hinge, 16 and 18, are illustrated, it is of course within the purview of the invention to use other types of clips and hinges.

Since it is desirable that prints be retained in the channels at both the top and the bottom of the first and second support members, it is desirable to provide a device of suitable size for each document size which is to be supported. While it is preferable that the length of the second support member 14 be one half of that of the support member 12, such that the documents will extend the full length of the U-shaped channels 44 and 46, but not project beyond the channels, it is of course within the purview of this invention to vary the relative length of the second support member 14 with respect to the first support member 12. In a particular embodiment of this invention, that is one intended to support documents which are approximately 24" wide by 36" long, i.e. the previously mentioned architectural D size document, the first support member 12 is made 37 inches long and the height between the bases of the U-shaped channels 32 and 34 is made $24\frac{1}{4}$". Further, the U-shaped channels 32 and 34 on the first support member are made approximately $15\frac{1}{4}$" long. The U-shaped channels 32, 34 and 44, 46 on the top and bottom edges of the first and second members are typically made $\frac{3}{4}$" wide and $\frac{3}{4}$" deep. It should also be noted that the hand hole 54 is located closer to the left end of the first support member 12 than to the right, so as to balance the weight of the device to the right and left of the hand hole. This takes into consideration the additional weight of the clip hinges and second support member 14.

While in accordance with the U. S. Patent statues, the preferred embodiment of the invention has been shown and described, various changes may be made in the device of this invention without parting from the true spirit and scope of this invention. The appended claims are intended to cover all such changes and modifications which fall within the true spirit and scope of this invention.

I claim:

1. A holder for holding a plurality of documents, and for displaying one of the documents comprising:

a first support member, said first support member having a generally rectangular flat surface, is adapted to correspond in size and shape to the size of the document to be held by the holder, said first support member flat surface having first and second pairs of opposite edges, retaining means adjacent said first pair of opposite edges of said first support member for retaining opposite edges of the plurality of documents, releasable securing means mounted on said first support member adjacent a first one of said second edges, for releasably securing the plurality of documents to said first support member, a second support member, said second support member having a generally rectangular flat surface, said second support member flat surface having a first pair of opposite edges, each of which is approximately one-half as long as said first opposite edges of said first support member, and having a second pair of opposite edges each of which is approximately the same length as the second pair of opposite edges of said first support member, retaining means adjacent said first pair of opposite edges of said second support member for retaining opposite edges of the documents, hinge means having first and second portions, said first portion secured to said first support member adjacent said first one of said second edges, said second portion secured to said second support member adjacent a first one of said second edges of said second support member, whereby, a portion of the plurality of documents secured by said releasable securing means which are on top of the document which is to be viewed may be disengaged from said retaining means adjacent said first pair of opposite edges of said first support member, and folded over said second one of said second edges of said second support member and retained by said retaining means adjacent said first pair of opposite edges of said second support member, such that all of said documents are supported by the holder and the document to be displayed is supported in a position for ready viewing.

2. The holder for holding a plurality of documents of claim 1, wherein said retaining means adjacent each of said first pair of opposite edges of said first support member, and said retaining means adjacent each of said first pair of opposite edges of said second support means are formed as U-shaped channels.

3. The holder for holding a plurality of documents of claim 1, wherein said releasable securing means is a spring loaded clip, a first clip portion of which is secured to said first support member, a second clip portion of which is pivotal about the first clip portion, and a spring which biases said first and second clip portion toward each other to engage the documents therebetween.

4. The holder for holding a plurality of documents of claim 2, wherein said retaining means are formed by bending the first pair of opposite edges of said first and second support members.

5. The holder for holding a plurality of documents of claim 1, wherein a hand hold is provided on said holder for the purpose of carrying said holder.

6. The holder for holding a plurality of documents of claim 5, wherein said hand hold is a generally rectangular slot formed in the first support member.

7. The holder for holding a plurality of documents of claim 1, wherein said hinge means is a pair of hinges each of which has a first portion mounted on said first support member and a second portion mounted on said second support member.

8. The holder for holding a plurality of documents of claim 7, wherein said hinges are provided with detent means for holding said first and second portions at predetermined positions with respect to each other.

9. The holder for holding a plurality of documents of claim 1, wherein said releasable securing means is positioned between said hinge means.

10. The holder for holding a plurality of documents of claim 1, wherein said first and second support members are formed of a plastic.

11. The holder for holding a plurality of documents of claim 1, wherein said first and second support members are formed of a metal.

12. The holder for holding a plurality of documents of claim 1, wherein said first and second support members are formed of a aluminum.

13. The holder for holding a plurality of documents of claim 2, wherein said U-shaped channels include a side member at a right angle to said support members and a retaining portion at a right angle to said side member, said retaining portion extending over and being parallel to said support member.

14. The holder for holding a plurality of documents of claim 11, wherein at least a portion of said retaining means extend toward each other so as to substantially overlap at least a portion of said first support member.

15. The holder for holding a plurality of documents of claim 1, wherein said first one of said second edges adjacent to which is secured said first portion of said hinge means, is bent at an obtuse angle to said flat surface of said first support member.

* * * * *